United States Patent [19]

Kohlen et al.

[11] Patent Number: 4,569,543

[45] Date of Patent: Feb. 11, 1986

[54] YARN KNOTTER ESPECIALLY FOR YARN SPOOLING MACHINES

[75] Inventors: Karl-Heinz Kohlen; Rolf Vieten, both of Mönchengladbach, Fed. Rep. of Germany

[73] Assignee: Hacoba Textilmaschinen GmbH & Co KG, Wuppertal, Fed. Rep. of Germany

[21] Appl. No.: 665,678

[22] Filed: Oct. 29, 1984

[30] Foreign Application Priority Data

Oct. 29, 1983 [DE] Fed. Rep. of Germany ..... 3339331

[51] Int. Cl.[4] ..... A01D 59/04; B65H 69/04

[52] U.S. Cl. ..... 289/2; 28/211; 289/18.1

[58] Field of Search ..... 289/1.5, 2, 3, 13, 18.1; 28/211

[56] References Cited

U.S. PATENT DOCUMENTS

| | | | |
|---|---|---|---|
| 3,696,477 | 10/1972 | Townsend | 28/211 |
| 3,813,742 | 6/1974 | Bar | 289/3 |
| 3,838,875 | 10/1974 | Franzen | 289/18.1 |
| 3,974,551 | 8/1976 | Baer et al. | 289/13 X |
| 3,990,732 | 11/1976 | Reichert | 289/2 |

*Primary Examiner*—Louis K. Rimrodt

*Attorney, Agent, or Firm*—Karl F. Ross; Herbert Dubno

[57] ABSTRACT

A knotting arrangement, especially for spool frames for warping and other textile machines in which the orbital knotting head is connected to a suction tube and has a freely movable clamping body, e.g. a ball, therein which, when air pressure is supplied to the suction tube can press the ball against a seat to hold the yarn end. The clamping body is not connected to any elements within the head and may be drawn by magnetic force against the seat.

14 Claims, 13 Drawing Figures

YARN KNOTTER ESPECIALLY FOR YARN SPOOLING MACHINES

CROSS REFERENCE TO RELATED APPLICATION

This application is related to the commonly owned copending application Ser. No. 658,494, filed Oct. 9, 1984 by Karl-Heinz Kohlen, one of the present joint applicants and based upon a German application No. P 33 36 509.1 filed Oct. 7, 1983.

FIELD OF THE INVENTION

Our present invention relates to a yarn knotter for textile machines and especially for yarn spooling machines. More particularly the invention relates to a yarn knotter of the type in which a suction tube draws a pair of yarn ends into an orifice of the tube and temporarily clamps the yarn ends therein so that movement of the suction tube can lay the yarn ends in the path of a knotting device which brings about the rotation of these ends in an appropriate manner to knot them together.

BACKGROUND OF THE INVENTION

A yarn knotter of the type which the present invention is concerned comprises a suction pipe having a suction opening which can receive the yarn ends and which is formed with a clamping seat against which a clamping body or member can move to engage the yarn ends against the seat after they have been sucked into the suction tube.

Earlier devices of this type utilize a suction tube with a widened tube end receiving the clamping member and which can be biased in the clamping or clamp-closing direction by a spring. To permit the yarn ends to be drawn by suction into the tube, the clamping body is drawn away from the seat by a lever and a bowden cable cooperating with the lever which is articulated to the clamping member. This allows the suction in the tube to reach the orifice at which the yarn ends are drawn into the tube. Thereafter, the bowden cable is so actuated that the clamping spring moves the clamping body into the clamping position to retain the yarn ends. This knotting device is expensive and unreliable since it is prone to mechanical failure. Tangling of yarn ends is also a problem.

In another arrangement the suction end of the suction tube has a clamping body shiftable between axial limits and traversed by a suction opening. The closing force here is also generated by a spring and the suction generated in the tube moves the clamping member against the force of the spring to unblock the suction opening in particular. The yarn ends can thus be drawn into the suction opening.

Because the suction opening remains open only as long as the suction force can act upon the clamping body against the spring force, suction must be applied for a considerable length of time and, because at least part of the suction force must counteract the spring force, the energy required to generate the suction at the pump is only partially utilized for drawing the yarn ends into the tube. This system is also not fully reliable and requires enhanced suction capabilities of the suction pump as well as increased operating costs.

OBJECTS OF THE INVENTION

It is the principal object of the present invention to provide a more reliable knotting device utilizing a suction tube.

Another object of this invention is to provide an improved knotting apparatus, especially for yarn ends in textile machines, particularly spooling machines, which operate at greater efficiency, has minimal maintenance cost and downtime, and which is comparatively inexpensive to make and utilize.

Yet another object of this invention is to provide an improved knotter capable of obviating the disadvantages enumerated above and which affords greater reliability over long operating periods than earlier yarn knotting devices.

SUMMARY OF THE INVENTION

These objects and others which will become apparent hereinafter are attained, in accordance with this invention in a yarn knotter which comprises a knotting unit capable of engaging a pair of yarn ends for tying a knot therein, a swingable suction tube having a suction opening adapted to receive these yarn ends and swingable to present the yarn ends in a substantially parallel orientation simultaneously to the knotting unit and a clamping body member received in said tube and juxtaposed with an annular seat through which the yarn ends can be drawn by suction so that this clamping body or member can engage the yarn ends against the seat. According to this invention the clamping body is movable within the suction tube with all-around clearance and free from any mechanical element in engagement therewith during such movement.

Because the clamping element is movable with all-around clearance in the suction tube the flow of air, which entrains the free yarn ends into the suction tube, can pass unimpeded around the clamping body so that the yarn ends are reliably drawn past the seat and, at an appropriate time, can be clamped thereagainst with equal reliability. This eliminates tangling of the yarn ends with the clamping body or anything attached thereto.

This is one reason why the lack of a mechanical attachment to the clamping body is important and indeed essential to the invention is that any such attachment could serve as an element which might, by damage or tangling with the yarns, be rendered inoperative. Since there are no mechanical elements connected to the clamping body for controlling its movements, the structure is greatly simplified and the number of parts reduced to a minimum, thereby decreasing wear and the cost of making the unit.

According to a feature of the invention, the suction opening communicates with a compartment receiving the clamping body through an annular seat and the clamping body is a ball of a diameter greater than the diameter of this seat but less than the diameter of the compartment formed at the tube end receiving this seat. The compartment can communicate with the suction pump by a smaller diameter portion of the suction tube.

This guarantees that the air can pass uniformly all around the freely movable ball and that the latter can effectively clamp the yarn ends against the seat at any location therearound.

The tube portion communicating with the compartment and of a diameter less than the ball, may be separated from the mouth of this tube portion at which it is connected to the compartment, by a retainer, e.g. in the form of a number of fingers so that the ball does not jam into this mouth. This configuration also prevents the clamping body through a rotation about its center of gravity or some other rotary movement from lodging itself against the inner wall of the head before the suction tube.

According to another feature of this invention, the clamping body is a magnetically attractable member which, in its clamping position lies within the influence of the attractive magnetic field of a permanent magnet fixed to the tube end and preferably exercising magnetic force against this element along the axis of this tube end and the annular seat. This magnetic force may generate sufficient force to hold the tube ends against the seat with the magnetic body. This permanent magnet can be located upstream from the seat by a distance sufficient that it is not contacted by the ball before it clamps the yarns against the seat. This provides a contactless closing force generator for the body.

In a yarn knotting installation in which a multiplicity of such suction tubes are connected in parallel to a common suction blower, the suction side of the latter can communicate with a suction chamber opening in turn into all of the suction tubes in parallel. The inlet to this compartment can be selectively connected to the suction and discharge sides of the blower, e.g. by a pair of flaps or flap valves to enable the yarn ends to be drawn into the suction tube in one position of these valves and to urge the clamping member against the yarn ends in the other position of these valves. In the latter position, the pressure from the blower serves as or contributes to the closing force of the clamping member without requiring the latter to have any mechanical means connected thereto.

When each of these valves is a respective flap, the flaps can be controlled by force transmitting elements such as bowden cables which can be mechanically coupled to the drive of the suction tube, i.e. the means whereby the suction tube end is orbited along a path enabling it to pick up the yarn ends and deliver the yarn ends to the knotting unit.

Since the closure can be effected solely by this pressure and/or the magnetic force as described, effective operation does not require any mechanical means applied to the clamping body, thereby ensuring simplicity and minimum weight of a knotting carriage displaceable along the spooling frame.

When the knotting carriage is shiftable horizontally along the spinning, twisting or spooling machine frame a respective orbital suction tube can be provided for each level or row of spools of the frame. This means that the knotting carriage can have $n \pm m$ knotting units each with a respective knotting tube, when n spool levels for one vertical row of spools are offset vertically from the m spool levels of a neighboring vertical spool row.

This construction of the knotting apparatus provides especially simple means for handling the knotting of yarn ends on spooling frames in which adjacent vertical columns of spools are vertically offset with respect to one another.

In a knotting system in which a knotting carriage is provided which should be connected to an electric current supply line connected, for example, to a stationary fitting and one end of the carriage, it has been found to be advantageous to provide rollers whereby the electric supply line can be guided so that the line always is more or less taut and can never be subjected to twisting or kinking which might interfere with the supply of electric current to the carriage. Up to now comparatively expensive and difficult to fabricate drag chains were required to prevent kinking of the electric line.

At least one of the rollers over which the line is deflected can be displaced by a compensating cable which can be connected to the carriage at one end and can pass around a stationary idler roll to another end of the path of the carriage.

The invention also applies to a method of knotting yarn ends in which the yarn ends are drawn into the suction tube and are there clamped in the manner described. The method utilizes the device of the invention which is free from mechanical connections to the clamp body, preferably in this method the clamp is closed by compressed air and may be held closed until suction is applied, e.g. by the magnetic force. The same parts are used for suction and pressure operation so that compressed air losses are also minimized.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
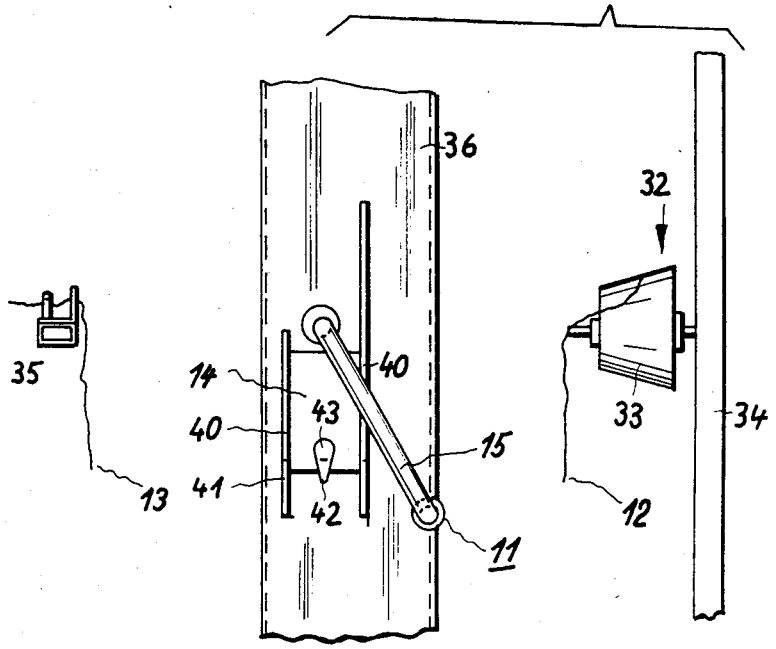
FIG. 1 is a schematic elevational view of one knotting stage of a yarn knotter in position along a spooling frame.

The yarn knotting apparatus shown in the drawing comprises a knotting unit, e.g. as described in the aforementioned copending application and which has been represented at 14, this knotting unit cooperating with a yarn positioning unit 25 for each of the knotters 26. The knotters 26, as can be seen from FIG. 7, can be disposed in a vertical row on a knotter carriage 27 which is guided along rollers 28 along rails 29 of a spool frame 30 in which the individual spools 32 with respective spindles and electric rollers etc. can be arranged in vertical spool columns 31 and 31'. At each spool stage 32, a spool 33 is disposed whose yarn 12 can be drawn off the spool in a yarn ribbon for a cone warping machine.

Each warp yarn 13 is thus tied to the end 12 on a replacement spool 33, the free end 13 from the previous spool being held in a thread brake 35 which ensures the desired tension upon the warp yarn thus produced in the warping frame.

Figure 2:
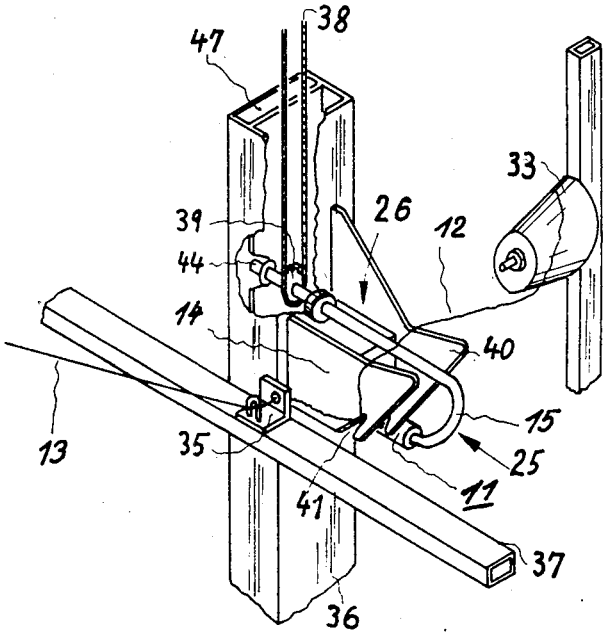
FIG. 2 is a perspective view of this stage more completely illustrated.

To knot the two yarn ends 12 and 13 together so that the yarn can be drawn from the spool 33 a suction tube 15 is swingably mounted on the upright 36 of the carriage about a horizontal axis as can be seen from FIG. 2 and has a suction head or end 11 which orbits this axis to bring its suction orifice first close to the end 12 and then close to the yarn end 13 so that these are picked up in turn by the suction applied to tube 15. The two yarn ends (FIG. 2) are then swung together into the notches 41 of a pair of guide plates 40 projecting from the knotter unit 14, the parallel yarns being then engageable by a beak 42 to form the knot in the manner described in the aforementioned application, the yarn ends previously being released by the clamp in the head 11 so that continued movement of this head will allow the yarn ends to be drawn out of the suction tube for the knot tying.

The suction tube 15, therefore, is bent in a J shape and has its end which is located on the longer shank, rotatably mounted on the support 36. This shank extends horizontally and thus parallel to the horizontal support bar 37 of the thread brake 35 (FIG. 2). The other end of the suction tube 15 is formed with the suction head 11 which engages the yarn ends 12 and 13.

The suction tube 15 is driven by a chain 38 which engages the sprocket wheel 39 on the shank of the suction tube 15 whose end 44 opens into a plenum which can be evacuated or pressurized in the manner to be described. The head 11 is therefore orbited in the manner described as the suction tube is rotated in the counter-clockwise sense. Consequently, the suction tube will first pick up the yarn end 12, will swing this yarn end over the guide plates 40 in the counter clockwise sense, will then pick up the yarn end 13 and draw the two yarn ends parallel to one another across the knotter unit while laying them in the notches 41 of the plates 40 where they can be engaged by the beak hood 42 of a tying beak 43 to form the knot. (see the aforementioned copending application).

The retention of the yarn ends 12 and 13 in the head 11 is described more fully below with reference to FIGS. 3–6.

The suction head 11 comprises a housing 17 of cylindrical configuration which is of a larger diameter than the tube 15 to which it is connected at one end 17'.

The housing 17 is closed at its opposite end by a cap 18 and is centrally provided with a partition 23' having a throughoing suction opening 23 which communicates via a compartment 19 with the intake orifice 24 for capturing the yarn ends 12 and 13. The lateral position of this orifice has been selected since that brings the orifice into the best proximity to the yarn ends when the suction tube 15 is rotated into the regions of the spool 33 and the thread brake 35.

The housing 17 is also formed with a compartment 20 for a clamping body 21, here shown to be a ball whose diameter is less than that of the suction opening 23 and hence the seat 23" formed by the periphery of the opening 23. The connector 17' may form a reducer which reduces the flow cross section between the compartment 20 and the suction tube 15.

Figure 5:
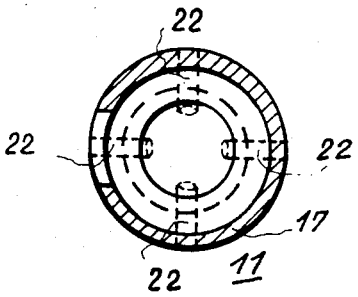
FIG. 5 is a transverse section through this end of the suction tube.
Figure 6:
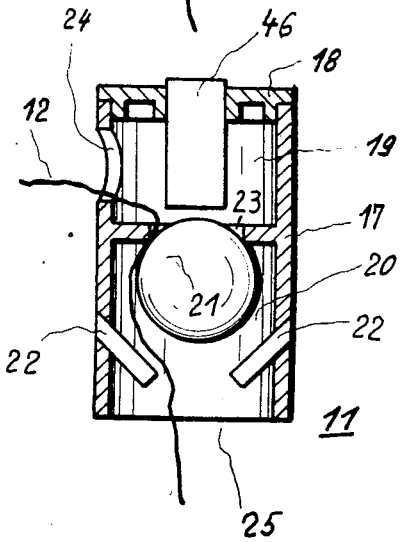
FIG. 6 is a view similar to FIG. 4 illustrating an embodiment in which a permanent magnet is used to hold the clamp in its closed position.

Within this compartment 20, the ball 21 is held out of the reducer portion 45 by a plurality of angularly equispaced pins 22 reaching radially into the compartment 20. FIG. 5 shows four such pins 22. The passage 45 is therefore unobstructed even when the ball 21 is in its lower position. It will be apparent that other retaining elements may be used to a similar effect as well.

Figure 4:
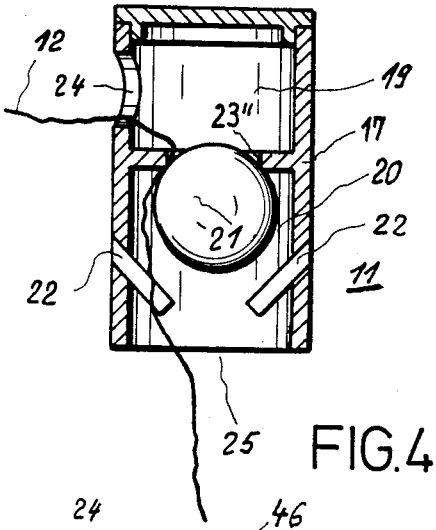
FIG. 4 is a partial section through this suction head showing the clamping body in another position.

As can be seen from FIG. 4, when pressure is applied through the tube 15, the ball 21 can clamp the yarn ends, e.g. the yarn end 12, against the seat 23" formed on the partition 23'. This allows the suction tube 15 to be rotated and the head 11 orbited without loss of the yarn 12.

Figure 3:
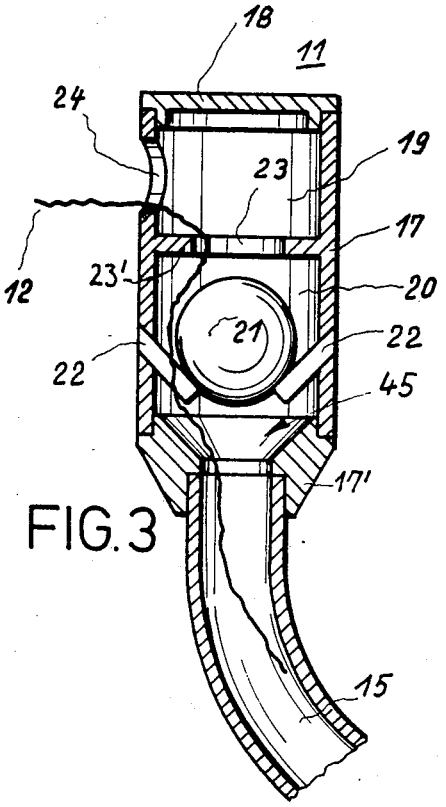
FIG. 3 is a longitudinal section through the suction tube at its end at which the yarns are drawn into this tube, i.e. at the suction head of the suction tube.

FIGS. 3 and 4 also show that the ball 21 is freely moveable on all sides and in no way is mechanically connected to the head 11. There is no connecting member which can entangle with the yarn ends or interfere with the withdrawal of the yarn ends for the knotting operation.

In the clamping position, a closing force can be applied by a permanent magnet 46 (FIG. 6) which can be fastened in the cap 18' and which reaches with one end close to the suction opening 23. Correspondingly, the clamping ball 21 must be magnetically attractive, i.e. may be composed of iron.

When suction is applied to the tube 15, the ball 21 is drawn away from the permanent magnet 46 to allow the yarn ends to be drawn sufficiently deeply into the suction tube. The suction effect becomes progressively smaller with increasing distance of the clamping ball 21 from the suction opening 23. When the suction is cut off, the magnet 46 draws the clamping body 21 once again against the seat. The same effect is obtained when the suction tube 15 is pressurized.

Referring now to FIGS. 7–11, it can be seen that suction is applied to all of the tubes 15 which can be disposed in a vertical column on the support 36 through a central suction passage or plenum 47 forming a manifold with which all of the ends 44 of the suction tube 15 communicate.

The suction blower 50 is also mounted on the column 36 of the knotter carriage and has a central intake 49 and which communicates as represented by a duct 48 with an intake compartment 78. The latter can communicate via a passage 51 or a passage 52 selectively with the plenum 47 or with the ambient atmosphere. A control flap 53 is swingable to selectively block one of the openings 51 or 52 while unblocking the other.

An outlet 54 can open into the ambient atmosphere as well and this opening and an opening 55 communicating the discharge side of the blower with the plenum 47 can be selectively opened and closed by a control flap 56.

Figure 10:
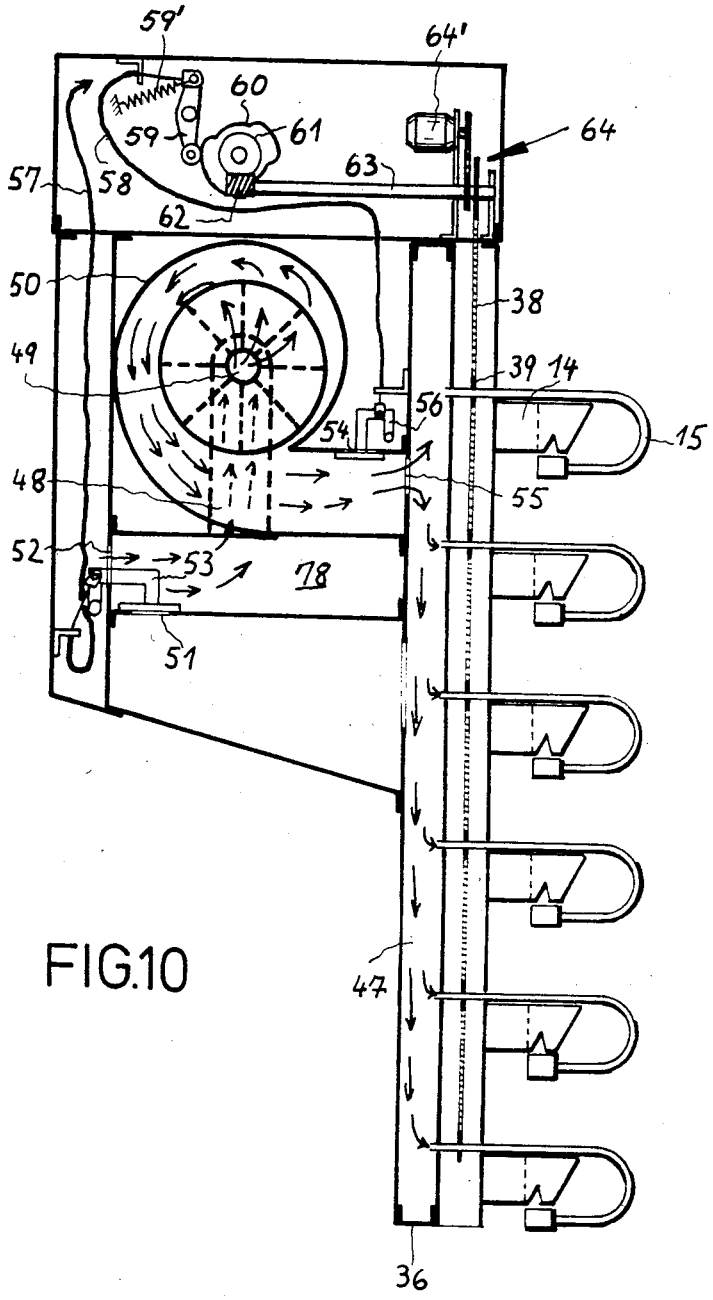
FIGS. 10 and 11 are diagrammatic side elevation views partially in section, of an apparatus showing the relationship of the suction blower to the knotting device.
Figure 11:
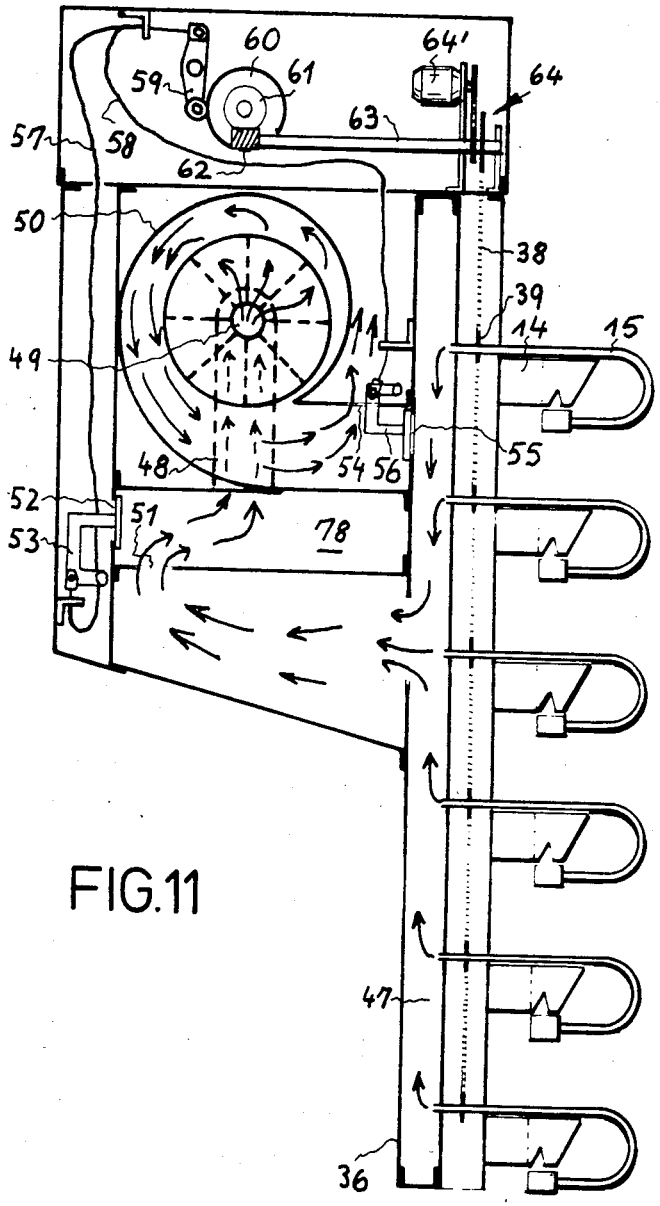

In the position shown in FIG. 11, suction is applied to the tubes 15, i.e. the openings 52 and 53 are closed and the openings 51 and 54 are unblocked. In the position shown in FIG. 10, however, air is supplied under pressure to the tubes 15 because the openings 52 and 55 are unblocked and the openings 51 and 54 are blocked. In the latter case, the balls 21 (FIG. 4) of the knotter heads are pressed against the respective seats in the clamping mode.

Figure 9:
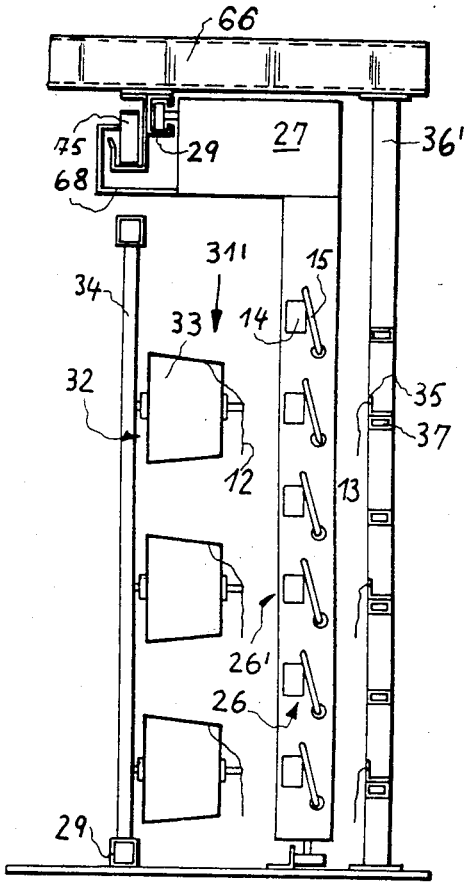

To control the flaps 53 and 56 we provide respective bowden cables 57 and 58, each of which is attached at the end of a respective cam follower lever 59 of which only one has been illustrated in FIGS. 9 and 10. Each lever 59 is biased by a spring 59' against a respective cam 60 of which also only one has been shown, the cams 60 being mounted on the shaft of a worm gear 61 which can be driven by a worm 62 in synchronism with the orbiting of the heads 11 of the suction tubes 15. To this end, the servo motor 64' which drives the chain 38 by a chain drive 64, also rotates the shaft 63 carrying the worm 62.

By corresponding shaping of the cam 60 we can ensure that for each rotation of the suction tube there will be an actuation of the respective cam follower lever 59 to switch the flaps by the positions shown in FIGS. 10 and 11 so that a clamping action in each spring head will follow intake of the yarn ends.

Instead of switching over from suction to compressed air, a similar valve arrangement can simply cut off the suction when a permanent magnet is used.

Figure 7:
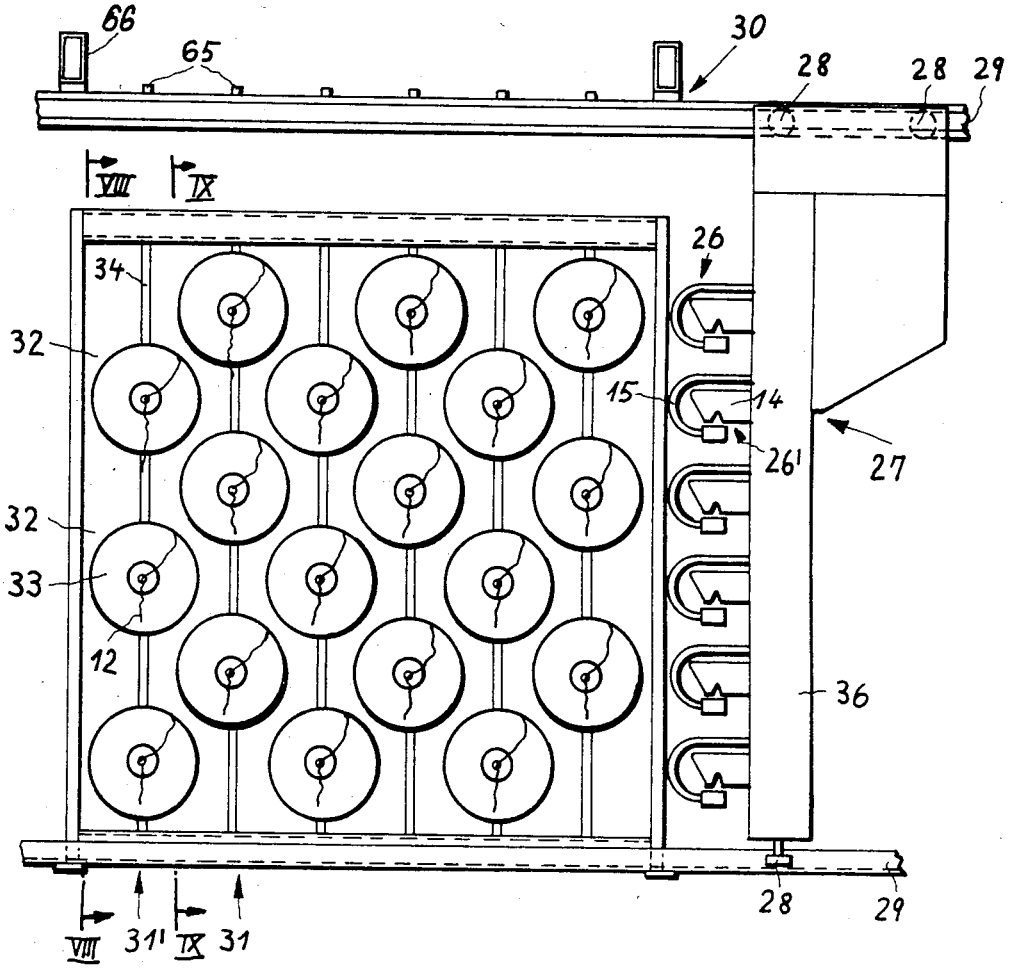
FIG. 7 is a diagrammatic side elevational view of a spooling frame showing the vertically offset vertical spool columns and a knotting carriage shiftable along this frame.
Figure 8:
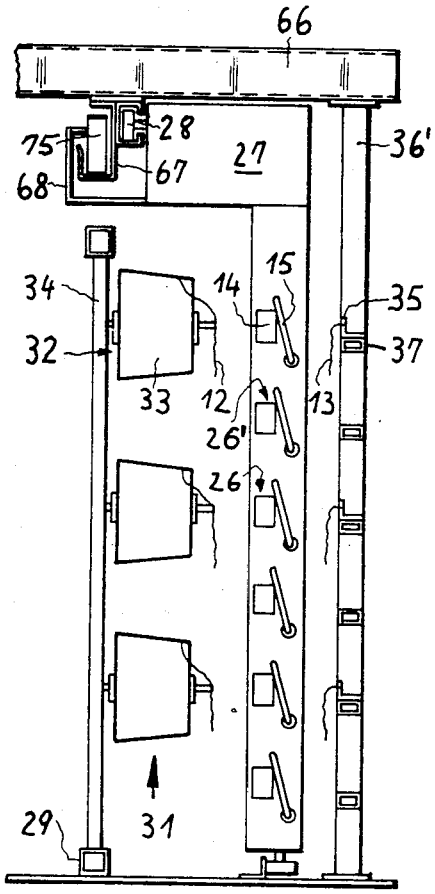
FIGS. 8 and 9 are simplified views along the lines VIII—VIII and IX—IX, respectively of FIG. 7.

From FIGS. 7–9, it will be apparent that the spool can comprise vertical bars 40 each of which carries a vertical column 31 or 31' of vertically spaced spools and that these columns of spools (compare columns 31 and 31') are vertically offset from one another. Thus each spool location 32 is located in a gap between spool locations of the next column. This allows a more compact construction of the spool frame and a greater number of spools for a given height. In large spooling frames, which may have several thousand spool locations, this makes a significant difference.

The knotting carriage, according to the invention, can accommodate the offset arrangement of spool locations by the stacked arrangement shown in FIGS. 7–9 in which a respective knotter assembly 26 is provided for each level of spools, i.e. the number of knotters in the vertical column on the support 36, is equal to the number of different offsets (here two) times the number of spool locations per column, here three. Naturally, only half the number of knotters are operative for each alignment of the carriage with a column of spools which have been replaced.

If one column contains m spools and the other column contains n spools were m and n are different, with a double offset arrangement as shown, the number of knotters on the carriage will be n and m.

FIGS. 8 and 9 show the knotters which are effective for each of the two columns.

Although some of the knotters may operate without tying yarn ends in each case, the cost of the apparatus in which the column of knotters corresponds to the total number of levels of spool locations is substantially less than when separate support carriages must be provided for the support columns.

The upper rail 29 and a vertical carrier 36' of the spool frame 30 are interconnected by transverse beams 66 on which, in addition, a profiled channel 67 is mounted, the latter carrying the current supply device for the carriage. This current supply device includes, as can be seen from FIGS. 12 and 13, a current-pick up stirrup 68 which reaches into the channel 67. This stirrup 68 is a rigid member which is provided with a connection to one end 69 of a movable conductor 70, the other end 71 of which has a fixed connection to the power lines. The fixed connection 71 is shown here to be located midway of the path of the knotter carriage which has been represented at 27.

The conductor 70 is a flat cable containing a stress relieving wire or the like to prevent excess tension from being applied to the conductive leads therein.

The conductor 70 is looped around an idler pulley 72 which is connected by a link 73 to a pulley 77 around which a compensating cable 74 passes, one end of this compensation cable being anchored at 74' to a location fixed with respect to the frame, while the other end after passing around an idler pulley 75 is connected to the carriage at the cap 68. The compensating cable 74 thus passes over idlers 75 and 76 which are mounted at stationary locations at opposite ends of the path of the carriage.

Figure 12:
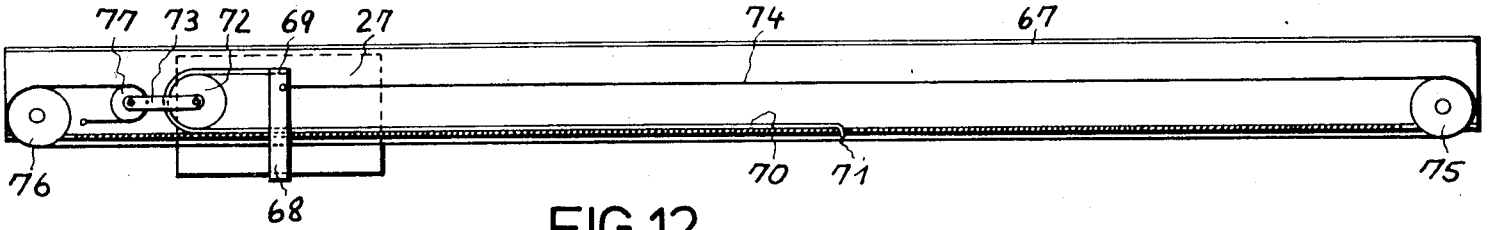
FIGS. 12 and 13 are side elevational views of an electric current supply arrangement for the knotter carriage.
Figure 13:
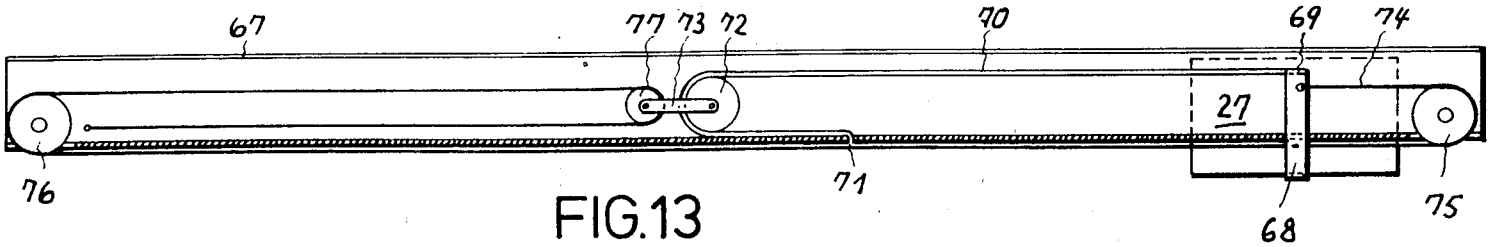

The manner in which the conductor 70 is held against kinking or twisting will be apparent from FIGS. 12 and 13 which also show that the entire device for holding the cable extended is contained within the length of the spooling frame.

Naturally, instead of a permanent magnet, an electromagnet may be provided at 46 on the head to draw the ball against the seat. In that case, the synchronism of the clamping operation is controlled electrically.

We claim:

1. The combination with a textile machine having yarn ends to be knotted of a knotter assembly comprising:

a suction tube having a suction head;

means for orbiting said suction head whereby said head draws said yarn ends into said suction head through a suction opening provided in said head;

a clamping body freely movable in said head and received with all around clearance therein and free from any mechanical actuating element attached thereto and attaching said body to said head, said clamping being juxtaposed with a clamping seat against which said body is movable to retain yarn ends drawn into said head; and a knotter unit receiving said yarn ends from said head for tying same together.

2. The combination defined in claim 1 wherein said clamping body is a ball disposed between said tube and said opening.

3. The combination defined in claim 2 wherein said body has a diameter greater than the diameter of said tube and less than the diameter of said head, said opening having a diameter less than the diameter of said body.

4. The combination defined in claim 3, further comprising a passage between said head and said tube and means for preventing obstruction of said passage in all positions of said body in said head.

5. The combination defined in claim 1, further comprising a magnetic force generator on said head for urging said body against said seat.

6. The combination defined in claim 5 wherein said magnetic force generator is a permanent magnet extending into said head to a location close to but spaced from said opening.

7. The combination defined in claim 1 wherein said assembly is mounted on a carriage together with a multiplicity of other assemblies in at least one column formed with a central plenum communicating with all of the suction tubes of said assemblies and associated with a single blower having a suction side selectively connectable with said plenum and ambient air and a discharge side selectively connectable with said plenum and ambient air.

8. The combination defined in claim 7, further comprising control flaps for switching over said blower between application of suction and application of air under pressure to said plenum.

9. The combination defined in claim 8, further comprising means for mechanically displacing said control flaps in synchronism with the orbiting movement of said heads.

10. The combination defined in claim 1 wherein said machine is a spool frame having columns of spools with successive columns of spools being vertically offset from one another, said assembly being provided on a carriage movable along said frame and having a multiplicity of such assemblies in a vertical column, wherein the vertically offset columns of spool locations have n and m spool locations respectively, said carriage having n+m knotter assemblies in a single vertical column thereon.

11. The combination defined in claim 1 wherein said machine is a spool frame and said assembly is provided on a carriage movable along said spool frame and is electrically powered, further comprising current supply means for said carriage including a conductor fixed at one end with respect to said spool frame and connected at an opposite end to said carriage and at least one pulley engaging said conductor for holding it against kinking in all positions of said carriage.

12. The combination defined in claim 11 wherein said pulley is connected to a movable idler wheel around which a compensating cable passes, said cable being anchored at one end to a location fixed with respect to said spool frame and at an opposite end to said carriage, said cable passing around pulleys at fixed locations at opposite ends of said frame, said conductor being supplied with electric current at a fixed location substantially midway between said ends of said frame.

13. The combination defined in claim 1, further comprising means for pressing said body against said seat with air pressure supplied through said tube.

14. In a method of operating a knotter for engaging yarn ends by orbiting a head along a path whereby suction is generated in said head to draw said yarn ends into said head, the improvement which comprises clamping said yarn ends in said head by applying air pressure to a clamping body freely movable in said head in a direction in which said body is urged against a seat.

* * * * *